US006976733B1

(12) United States Patent
Biederman et al.

(10) Patent No.: US 6,976,733 B1
(45) Date of Patent: Dec. 20, 2005

(54) FOLDING CHAIR WITH INTEGRAL TABLE

(75) Inventors: Daniel A. Biederman, Chappaqua, NY (US); Ignacio Juan Ciocchini, Astoria, NY (US)

(73) Assignee: Bryant Park Restoration Corp., New York, NY (US)

( * ) Notice: Subject to any disclaimer, the term of this patent is extended or adjusted under 35 U.S.C. 154(b) by 0 days.

(21) Appl. No.: 11/006,391

(22) Filed: Dec. 7, 2004

(51) Int. Cl.[7] ..... A47C 7/70
(52) U.S. Cl. ..... 297/160; 297/162; 297/41; 297/57; 297/173
(58) Field of Search ..... 297/35, 39, 41, 297/56, 57, 154, 155, 160, 162, 170, 171, 297/173, 40

(56) References Cited

U.S. PATENT DOCUMENTS

| | | | | | |
|---|---|---|---|---|---|
| 328,322 | A | * | 10/1885 | Lindsay | 297/41 |
| 940,582 | A | * | 11/1909 | Burrowes | 397/57 |
| 1,864,750 | A | * | 6/1932 | Moore | 297/41 |
| 2,048,014 | A | * | 7/1936 | Lochman et al. | 297/57 |
| 2,675,062 | A | * | 4/1954 | Clarin | 297/41 |
| 3,547,488 | A | * | 12/1970 | Barnes | 297/162 |
| 4,241,950 | A | * | 12/1980 | Simpson | 297/39 |
| 4,662,676 | A | * | 5/1987 | Havelock | 297/160 |
| 4,890,881 | A | * | 1/1990 | Ollat et al. | 297/26 |
| 5,139,309 | A | * | 8/1992 | Kornreich | 297/162 |
| 5,873,624 | A | | 2/1999 | Simpson | 297/45 |
| 6,364,411 | B1 | | 4/2002 | Zheng | 297/173 |

* cited by examiner

*Primary Examiner*—Peter R. Brown
(74) *Attorney, Agent, or Firm*—Abelman, Frayne & Schwab

(57) ABSTRACT

A folding chair suitable for outdoor use includes a table supporting arm and a foldable table that rotates between a position for use by one seated in the chair and a stowed position. The chair can be folded flat with the table parallel to the folded chair legs.

20 Claims, 6 Drawing Sheets

FIG. 4
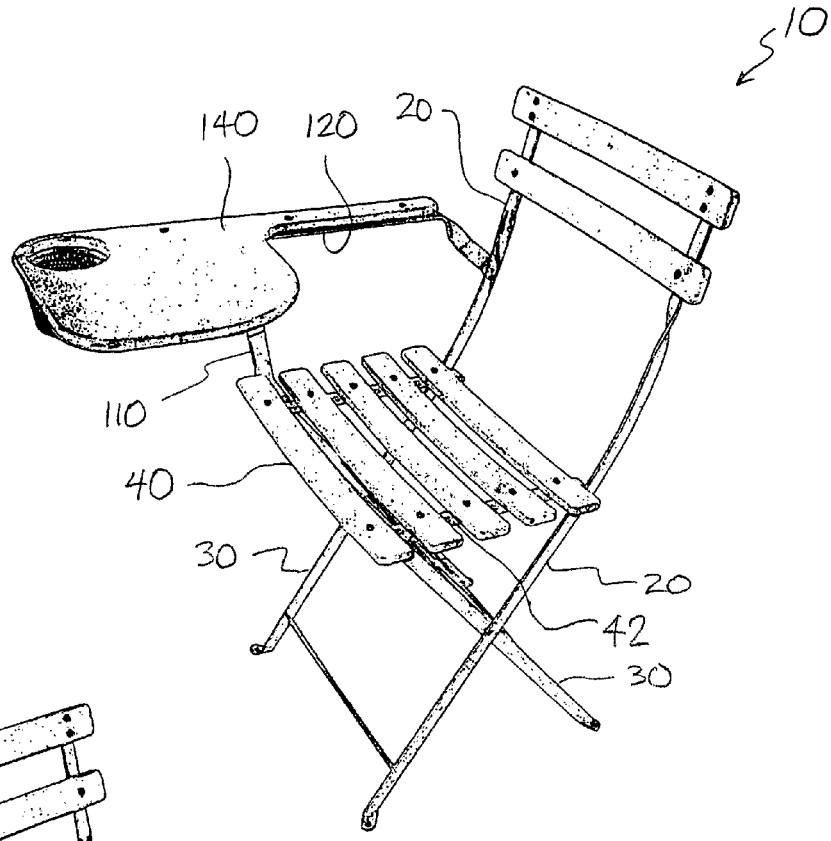
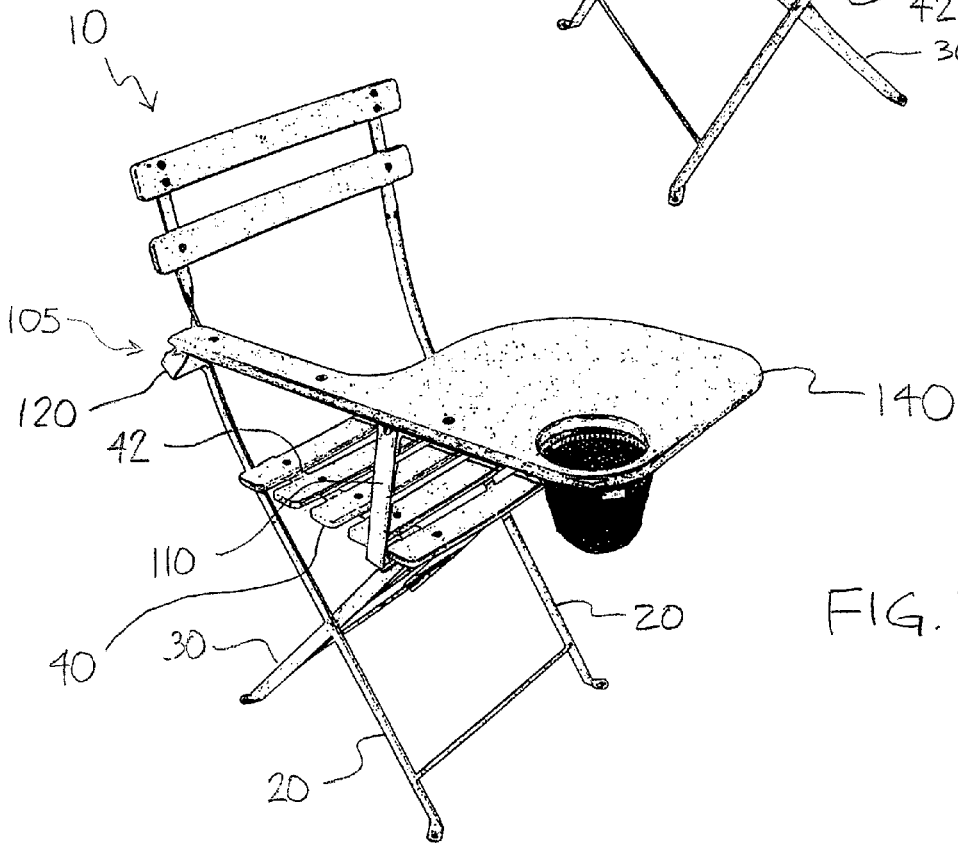
FIG. 3

FOLDING CHAIR WITH INTEGRAL TABLE

BACKGROUND

1. Technical Field

The present invention relates to folding chairs and, specifically, to folding chairs for outdoor use having an integral table.

2. Background of Related Art

Folding chairs of the prior art suitable for outdoor, lawn or park use are constructed to endure exposure to seasonal weather, heavy use and fold into a flat stackable configuration. These outdoor chairs, however, are limited in their ability to be used in activities such as playing cards, board games, reading and using computers without the use of a separate table. In particular, the recent creation of wireless networks and wireless fidelity (wifi) hotspots in many urban communities has increased the need for a chair having an integral table suitable for use by an individual with a portable computer such as laptop or notebook.

Prior art folding chairs include configurations with armrests, but the armrests lack sufficient width to provide a working surface or the ability to be positioned in front of a seated individual to perform activities such as using a computer. Armrests of the prior art are also limited in their ability to provide support for a table. Conventional chairs with a pair of armrests cannot accommodate a table surface, since access to the seat would be blocked. For example, when a foldable table is oriented for use, the distance between the table and seat does permit easy access into the chair. Further, the distance between the table when oriented for use and the seat limits the size of persons that can comfortably sit in the chair due to their large body size.

A need exists for an outdoor folding chair having an integral table that is stackable in a folded position and the table is adapted for separately pivoting into a stowed position when the chair is unfolded for use.

It is therefore an object of the present invention to provide a folding chair with an integral table, where the chair and table have a use-oriented position and a compact folded position suitable for stacking and storing.

It is another object of the present invention to provide a folding chair with an integral table, where the chair has a use position with the table in a stowed position.

It is yet another object of the present invention to provide a folding chair having a distance between the seat and table suitable for accommodating a broad range of body sizes.

It is a further object of the present invention to provide a folding chair with an integral table, where the table has a working surface suitable for use with a laptop computer.

SUMMARY OF THE INVENTION

The above objects and other advantages are provided by a scissors-type folding chair having two pairs of crossed and pivotally connected legs supporting a back a seat or seat assembly, a table supporting arm and an integral folding table. The folding table has a use position, a stowed position in which the table is rotated to a vertical stowed position beside the chair, and a storage position in which the chair and table are folded into a compact flat superposed position for storage.

The invention broadly comprehends a scissors-type folding chair in which the rear portion of the seat is lifted or moved toward the backrest in order to pivot the legs and bring their supporting ends together, the chair being provided with at least one table-supporting arm that is rotatable to provide direct access to the seat.

In one preferred embodiment, the folding chair has a frame that includes a first set of interconnected parallel frame members and a second set of interconnected parallel frame members. The first set of frame members and the second set of frame members are connected for rotation about pivoting joints. The frame members define the chair legs, a chair back portion, and support the chair seat and backrest.

A table-supporting arm is pivotally connected at one end to one of the frame members proximate the backrest and at its other end to a downwardly depending supporting member that is pivotally attached to the upper portion of the front leg proximate the seat. The table is rotatably connected to the table-supporting arm and movable between a first position wherein the chair is positioned for seating and the table is oriented for use and a second position wherein the chair is positioned for seating and the table is rotated to a stowed position beside the chair. The chair and table are foldable to an essentially flat compact superposed position for storage. The leading edge of the table preferably does not extend beyond the ends of the folded legs.

In an alternative embodiment, the table is fixedly mounted on the supporting arm and folds flat in the storage position, but does not rotate to a stowed position beside the chair.

The invention, together with attendant advantages, will be further described with reference to the following detailed description of the invention and the attached drawings.

BRIEF DESCRIPTION OF THE DRAWINGS

Preferred embodiments of the folding chair with integral table invention are described with reference to the drawings, in which like reference numerals identify the same or similar elements throughout the several views, and wherein:

FIG. 3 is a right perspective view of one preferred embodiment of a foldable chair of the invention with integral table;

FIG. 4 is a left perspective view of the foldable chair with integral table of FIG. 3;

DETAILED DESCRIPTION OF PREFERRED EMBODIMENTS

Figure 1:
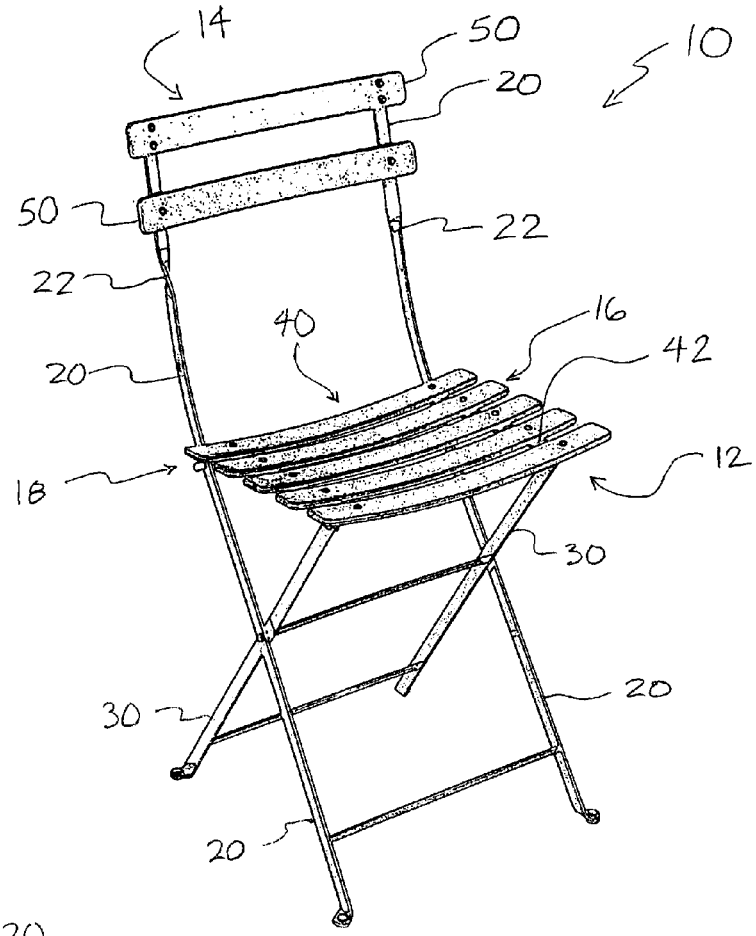
FIG. 1 is a perspective view of the prior art foldable chair in a position for use.
Figure 2:
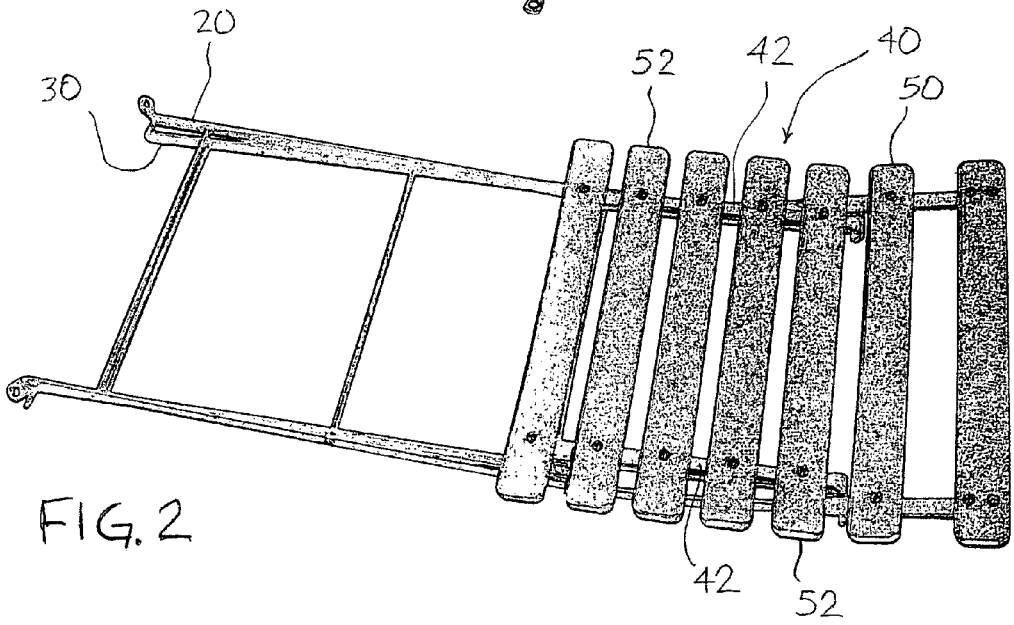
FIG. 2 is a perspective view of the prior art chair of FIG. 1 in a folded position.

Referring to FIGS. 1 and 2, there is illustrated one embodiment of a foldable chair of the prior art in a use position and a folded storage position. Folding chair 10 has a front 12, a back 14, a left side 16, and a right side 18. Chair 10 defines a reference frame from a position seated in chair 10 wherein alignments are referred to being front and back or directionally aligned forward and backward or left and right or directionally aligned side-to-side.

Folding chair 10 is described herein with reference to one preferred embodiment which the material of construction of the frame members are steel bar stock and the seat and backrest elements are wood or plastic slats. The materials of construction of the frame members for chair 10 are not limited to steel bars and can include aluminum tubing, other metal alloys, wood, plastics and composites. Frame members can also have shapes such as rods, tubes and formed sheets such as stamped metal pieces or extruded plastics. The materials of construction of back rest 50 and seat 40 for chair 10 are not limited to cellulic materials and can additionally include metal alloys, composites, plastics and cloth. The seat and backrest can also be formed as flat or contoured panels.

Similarly, references to a pair of frame members, for example, includes a set of at least one frame member wherein a set of frame members can range from being a single frame member to a plurality of frame members.

Chair 10 includes a first pair of interconnected mirror image bars or frame members 20, a second pair of interconnected mirror image bars or frame members 30 and a seat 40. Bars 20 are configured as a pair of front legs and a back for chair 10. Bars 30 include only leg portions having edges aligned in the forward and backward directions. The leg portions of bars 20 also have their edges aligned forward and backward and are connected with bars 30 at a rotating joint approximately mid-way between the ground surface and seat 40 of chair 10. Bars 20 and bars 30 fold in a scissor-type pivoting action.

The upper portion of bars 20, defining the back of chair 20, includes a ninety-degree twist 22 such that the formerly forward to rear alignment of the edges of bars 20 is changed to a side-to-side edge alignment. The side-to-side alignment of the edges of bars 20 in the upper portion positions the greater surface area of the flat side of the bar in a forward direction for connecting slats for a backrest 50. The second pair of mirror image bars 30 is a pair of chair legs extending from a back position on the ground forward. This construction is conventional in the art.

The rear portion of seat 40 is connected with bars 20 for the pivotal sliding and rotating of the back of seat 40 along the upper portion of bars 20 toward the back rest. The front portion of seat 40 is pivotally connected with the forward end or seat support portion of the second pair of bars 30. In one preferred embodiment, seat 40 includes a pair or set of seat support bars 42 positioned to provide structural support for the slats 52 defining the seat 40 of chair 10. Bars 42 are frame members and in this embodiment are preferably fabricated from bar stock or stamped metal pieces defining a U-shaped channel with plastic inserts positioned in the load-bearing ends.

In an alternative embodiment, seat 40 includes in addition to bars 42 or as a substitute therefore, a material of seat 40 such as one or more of canvas, fabrics, plastics, composites or metals that are directly connected to the forward end of the second pair of bars 20 and the upper portion of bars 20. In this embodiment, for example, a flexible composite, plastic or metal wire or fabric support bar 42 can support a seat made of plastic, fabric and rigid or flexible slats.

Bars 20 have a stop or interconnection 18 positioned to limit the downward travel of seat 40. As chair 10 folds, the front end of seat 40 pivotally connected to the front end of the pair of second bars 30, folds down onto legs 20 and the rear portion of seat 40 slides up bars 20 towards backrest 50.

Referring now to FIGS. 3 and 4, chair 10 has an integral table folding and stowing system 105 including a first support 110, a chair arm 120, a hinge 130 (best shown in FIG. 7), and a foldable table 140. Table folding and stowing system 105 is an integrated, folding system formed of bars 20, bars 30 and seat 40.

First support 110 and chair arm 120 are frame members and as illustrated in this embodiment are made of standard metal bar stock, similar to that of bars 20, 30, and 42. Chair 10 also preferably includes exterior coatings such as paint, plastic coatings, and/or sealants to resist the impact of seasonal weather.

Figure 8:
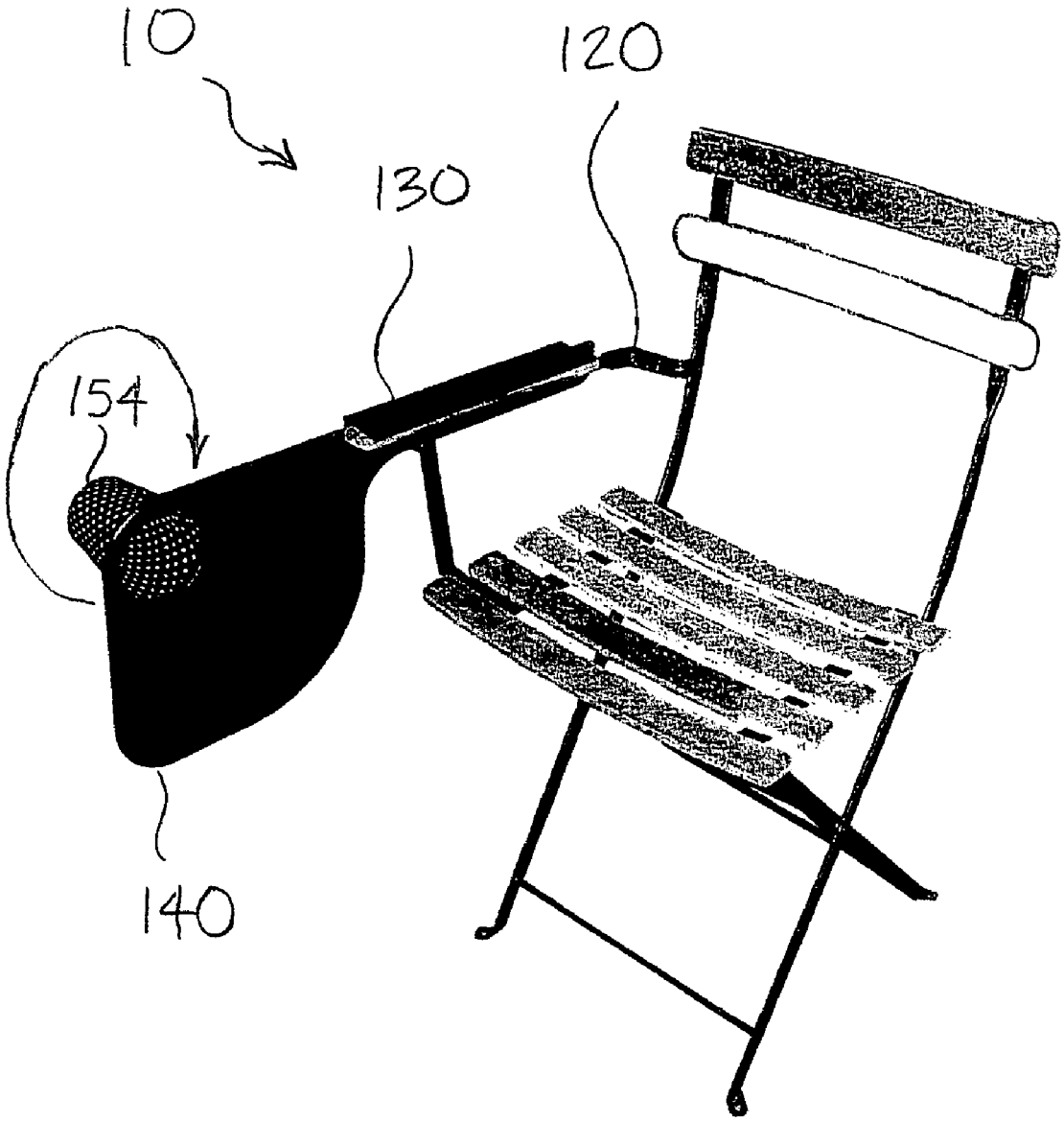
FIG. 8 is a left perspective view showing the foldable chair with integral table of FIG. 3 in a second position and the movement of the table from the use position to the stowed position.

Chair 10 has a first position suitable for seating with table 140 oriented for use generally directly forward of and beside seat 40, a second use position (as shown in FIG. 8) with table 140 stowed beside and below the arm, and a third or storage position (See FIG. 9) which chair 10 is folded and suitable for stacking or storing. Chair 10 is illustrated with a right-handed table 140, but it is understood that the invention of chair 10 and integral table folding and stowing system 105 also encompasses a left-handed table 140.

As shown in FIGS. 3–6, vertical support member 110 has a first end portion 112 that generally is vertically aligned and pivotally connected with the front ends of one the bars of second pair of bars 30 and/or one of the bars of seat support 42. When chair 10 is in the use position, vertical support member 110 has a front to rear edge alignment consistent with bars 30 and 42 with a first bend 116 turning horizontal and outward from the vertical past the cantilevered ends of the slats 52 of seat 40. A second bend 118 of vertical support 110 turns upwardly from the horizontal, terminating in second end portion 114.

Referring now to FIGS. 5–8, chair arm or frame member 120 is a table-supporting arm having a rear portion 122 and a front portion 124. Rear portion 122 is pivotally connected to one of first pair of bars 20 for folding. The edges of back portion 122 are aligned forward and backward and parallel with the edges of first pair of bars 20 at that position. Back portion 122 includes a first bend 121, a second bend 123, a third bend 125 and a ninety-degree twist 127. First bend 121 is approximately perpendicular and extends arm 120 outwardly from one bar of the first pair of bars 20 a predetermined distance to accommodate an ergonomically suitable amount of seating area with table 140. Second bend 123 and third bend 125 combine to elevate the position of front portion 124 and provide a foundation for table 140. Ninety degree twist 127 is positioned in the vicinity of third bend 125 and turns the edges of support 120 to a horizontal or left-to-right alignment as seated in chair 10.

Back portion 122 is angled to ergonomically accommodate the seating of individuals below table 140. Front portion 124 extends from back portion 122 forward and provides the armrest and a foundation for table 140. Front portion 124, including or excluding hinge 130, can have a planar upper surface suitable for use as an armrest, an ergonomically contoured and/or cushioned configuration for receiving elbows and/or forearms, or a simple frame member for structurally supporting table 140. Front portion 124 and table 140 are preferably horizontal or very close to horizontal in order to provide a comfortable position and height for the armrest as well as for the stable positioning of items, such as food and beverage, books or lap top computers so that items will not slide off.

Front portion 124 extends forward from twist 127 to structurally support table 140 and terminates in a front end 129. Chair arm 120 also includes a downwardly cantilevered extension 128 configured as a frame member. Extension 128 has edges aligned front to rear and is positioned perpendicular to the alignment of arm 120 to align with, and pivotally connect to second end portion 114 of vertical support member 110.

Hinge 130 can include both a rotating hinge and a pivotal connection between arm 120 and table 140, and can be in one or several sections. Hinge 130 has a back portion 132, a front portion 134, and a hinge axis 136 and is generally aligned with arm 120. Back portion 132 is preferably positioned forward of twist 127. Front portion 134 can be positioned to terminate at front end 129 or extend beyond arm 120. Hinge axis 136 provides for the rotation of table 140 through approximately 270 degrees. In one preferred embodiment, hinge 130 and table 140 rotate from the first position of chair 10 to the second position having a generally vertical alignment.

Hinge 130 provides for the rotation of table 140 between the use and stowed positions and can be a single hinge having configurations such as a continuous or piano hinge, a flexible hinge employing a fabric, plastic or composite material, or a pivot such as a pin movable within a defined slot or multiple hinges. Hinge 130 as a pivot can include a bracket having a slot positioned on arm 120 such that table 140, connected to a pin in the bracket, can pivot between the use and stowed positions.

Hinge 130 can include multiple hinges 130 aligned along one axis 136 or multiple axes 136. For example, a first hinge axis 136 can be positioned on an outer side, at least partially within or on a bottom of arm 120 and a second hinge axis 136 can be connected to and aligned with a lower outer edge of table 140. Hinge 130 can be connected at any position on or internal to arm 120 including the upper surface of arm 120, however, in a preferred embodiment, hinge 130 is connected to the lower surface of arm 120.

The materials of construction for hinge 130 can include one or more of plastics, fabrics, metals and composites suitable for use as a structural support for table 140 when chair 10 is in the first position and/or have a structure solely to support the rotation of table 140. Hinge 130 can also be suitable for use as an armrest or arm 120 and be cushioned or have coatings to provide a comfortable surface. Alternatively, arm 120 and/or hinge 130, can have an ergonomic configuration suitable for comfortably supporting a forearm and/or an elbow. Arm 120 can also include a wood or plastic material positioned on top of front portion 124 such that arm 120 has a size suitable for supporting hinges 130 and table 140. Arm 120 having a broader width than standard bar stock as used herein, can, for example, advantageously provide improved stability for the mounting of hinge 130 and the foundation for table 140.

In one preferred embodiment, a reinforcing member 135 is positioned between arm 120 and table 140. Reinforcing structure 135 is a frame member and can be, for example, a piece of metal bar stock providing improved structural stability of table 140 when chair 10 is in the first use position. Reinforcing member 135 can be positioned between hinge 130 and table 140 and can extend as a cantilever structural support below the front edge of table 140 if the table is made from a lightweight or unreinforced material, e.g., molded plastic.

In another embodiment, reinforcing member 135 can be configured to elevate table 140 above arm 120 and thereby ergonomically accommodate the seating of a broader range of body types below table 140. In this embodiment, arm 120 can be a straight frame member having a first angle for back portion 122 and a second angle for front portion 124.

Figure 6:
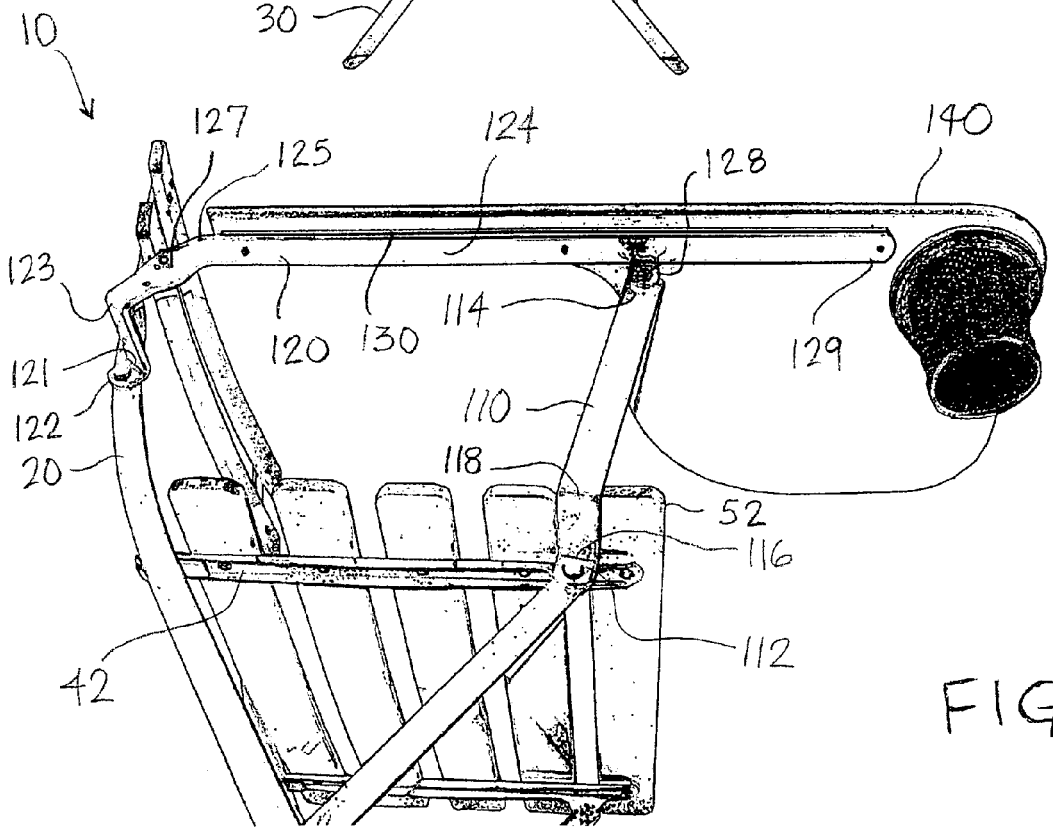
FIG. 6 is a bottom close up view of the foldable chair with integral table of FIG. 3 showing a table supporting arm, a hinge, a reinforcing member, and the lower surface of the table.
Figure 7:
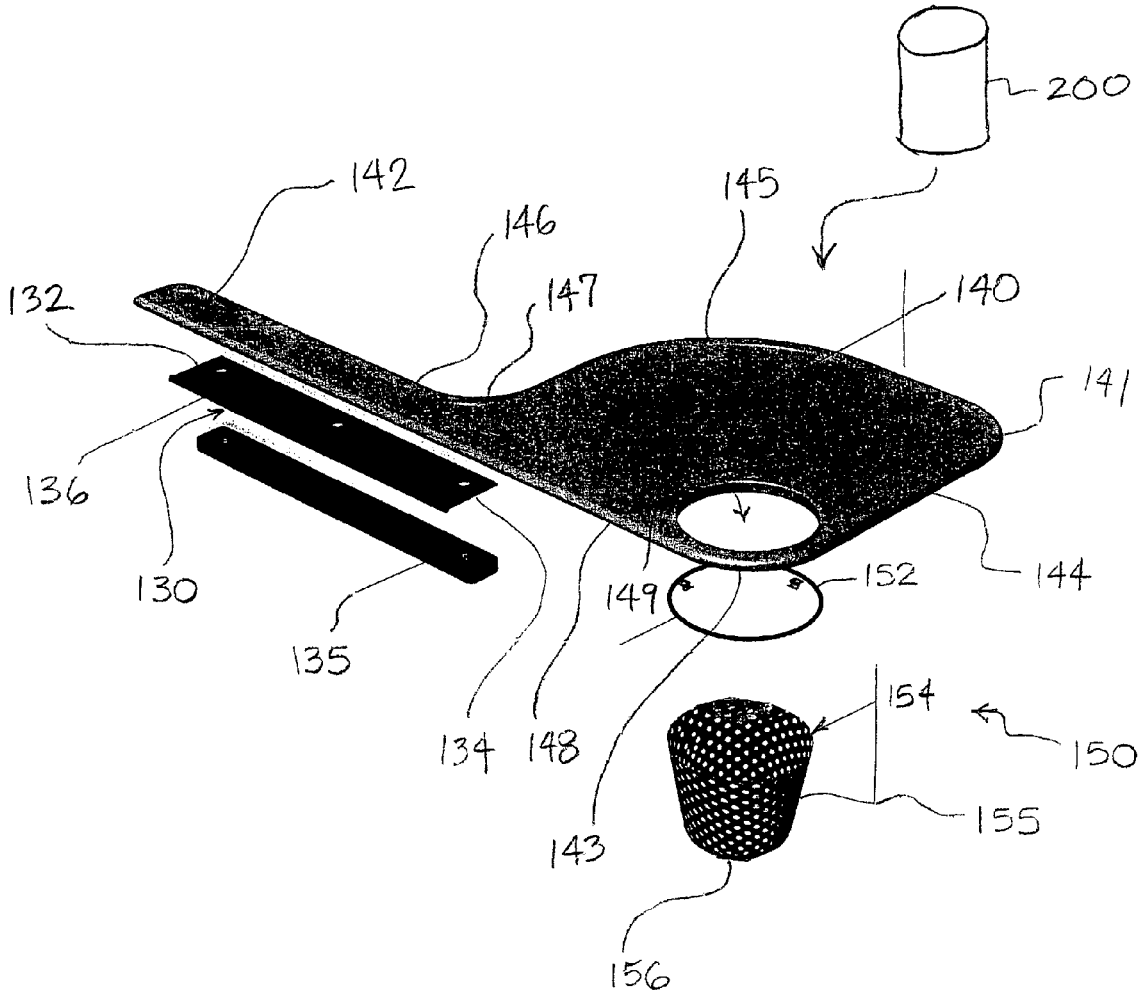
FIG. 7 is an exploded view of the foldable chair with integral table of FIG. 3 showing a hinge and a receptacle.

Referring now to FIGS. 6–8, as illustrated, table 140 is planar with a rear portion 142 and a front portion 144 having rounded edges and corners. Rear portion 142 is a flat elongate portion suitable for use as an armrest. Rear portion 142 and front portion 144 have an inner edge 146 and an outer edge 148. Outer edge 148 is aligned with hinge axis 136. Back portion 142 includes an approximately semi-circular back, in the vicinity of bar 20.

Front portion 144 preferably has a polygonal shape with rounded corners. In one preferred embodiment, front portion 144 has a generally square shape with two front rounded corners 141 and 143, a back rounded corner 145 and a rounded interior angle 147. Back portion 142 and front portion 144 are connected in the vicinity of back rounded interior angle 147. The two front corners 141 and 143 as well as rounded interior angle 147 have a similar radius of curvature. Back rounded corner 145 preferably has a larger radius of curvature than corners 141, 143, and rounded interior angle 147. Front portion 144 can also have a front to back narrowing taper, a triangular shape, or include arcuate shaped sides, for example.

The upper surface of table 140 provides a planar surface area suitable in size and texture, and is essentially horizontal for uses such as writing, reading and/or the positioning of a lap top computer. Fasteners used in conjunction with table 140 are countersunk, filled, and/or covered over such that table 140 provides a smooth uninterrupted planar surface. It is understood that the table 140 can be of any shape that provides the functionality desired. Materials of construction for table 140 include one or more of wood and wood products such as plywood, plastics including simulated wood designs and/or lightweight molded plastics, composites, ceramics and metals, including castings and formed sheet metal.

The horizontal or slightly angular position of the upper surface of table 140 in the use position is determined by the length of extension 128, the length of vertical support 110 and the positioning of the back pivotal connection of arm 120 on first bar 20. The angular position of table 140 is sufficiently close to being level so that table 140 can accommodate an open book or a laptop computer without sliding off. The distance between seat 40 and table 140 is ergonomically determined to comfortably accommodate a broad range of human body sizes, e.g., adults and children. The proportions of the entire chair assembly can also be adapted to accommodate users that are appreciably above or below the average body type.

Hinge 130 is positioned so that when chair 10 is in the first position, table 140 is movable between a use position and a stowed position. Table 140 in the use position has at least the lower surface of the back portion 142 positioned on arm 120 and table 140 is suitable for use as a workstation for a computer as well as a table for writing, card games, board games or positioning a book for reading. Table 140 in the stowed position is rotated approximately 270 degrees about hinge 130 so that the upper surface is approximately vertically aligned and facing towards the chair.

Table 140 also preferably includes a through hole 149 and receptacle to receive a cup, can, or bottle, or for holding eyeglasses, a cigarette pack or the like. In one embodiment, opening 149 is positioned in front portion 144 and in the vicinity of one of corners 141 or 143 so as to minimize interference with the working surface of table 140. Receptacle 150 is preferably positioned in the vicinity of corner 143 and hinge 130 so as to reduce its likelihood of contact with passersby and to accommodate some limited rotation of table 140 without excessively titling the contents of any container 200 positioned therein.

As illustrated, receptacle 150 preferably includes an annular rim 152 and a pocket 154. Rim 152 is connected to an inner edge of hole 149 and pocket 154. Rim 152 can be any material configured for connecting to the inner edge of hole 149. In one preferred embodiment, rim 152 is made of galvanized steel and connected with fasteners such as galvanized steel clips. Alternate materials for rim 152 and its fasteners include, for example, plastics and composites.

Pocket 154 has sides 155 and a bottom 156. In one embodiment, pocket 154 defines a circular opening and sides 155 are tapered and define a cone truncated by bottom 156. Pocket 154 is preferably made of a flexible web material such as plastic coated cloth mesh, but it can be rigid, include perforations, or omit bottom 156, for example, wherein the conical taper of pocket 154 has suitable dimensions to retain the bottom or sides of container 200 in position at convenient depths. Opening 149, rim 152 and pocket 154 can be of any shape, including square and circular and size. Similarly, pocket 154 can have any shape, such as cylindrical or cubical, and define any depth from rim 152 to bottom 156 suitable for receiving containers 200 or other personal articles.

As shown in FIG. 3, chair 10 in a first position includes table 140 in a use position suitable for writing or positioning of items thereon with edges 146 and 148 having a left to right orientation. Front portion 144 is at least partially positioned directly in front of seat 40. Table 140 is proportioned with the relatively large radius of curvature of rounded back corner 145 to easily accommodate the movement by a broad range of users between a seated and a standing position. In addition, when table 140 is level or approximately level, two chairs 10 can be positioned with the front ends of their tables 140 adjacent to provide a larger upper surface for a game of chess, checkers or cards, for example.

Referring now to FIG. 8, chair 10 is folded to the second position from the first position by pivoting table 140 about hinge 130 approximately 270 degrees from the use position to a stowed position a vertical orientation. In the second position of chair 10, table 140 is positioned outside of arm 120 with the upper surface of table 140 facing and adjacent to arm 120. Pocket 154 is preferably fabricated from a flexible material that can be collapsed or folded in the stowed or storage position and does not extend substantially outward from the lower surface of table 140.

Table 140 can be readily moved between the stowed and use position. Rotating table 140 to the stowed position for persons leaving or entering the sitting position in chair 10 enables folding chair with integral table 10 to be readily accessible to users of a broad range of body types.

Figure 5:
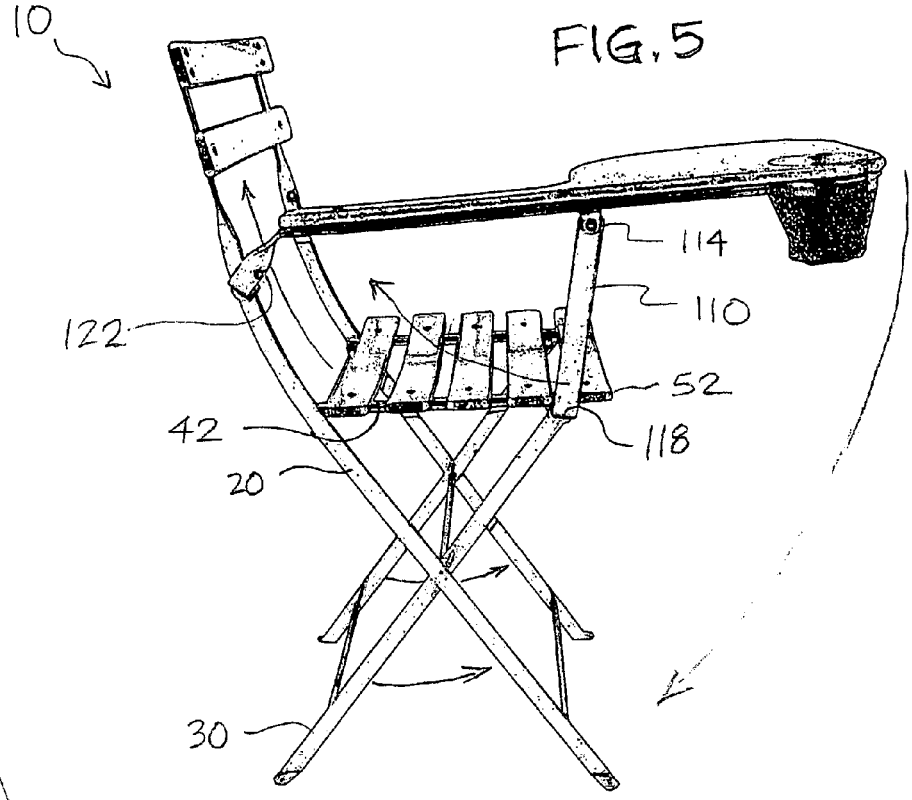
FIG. 5 is a right side view of the foldable chair with integral table of FIG. 3.
Figure 9:
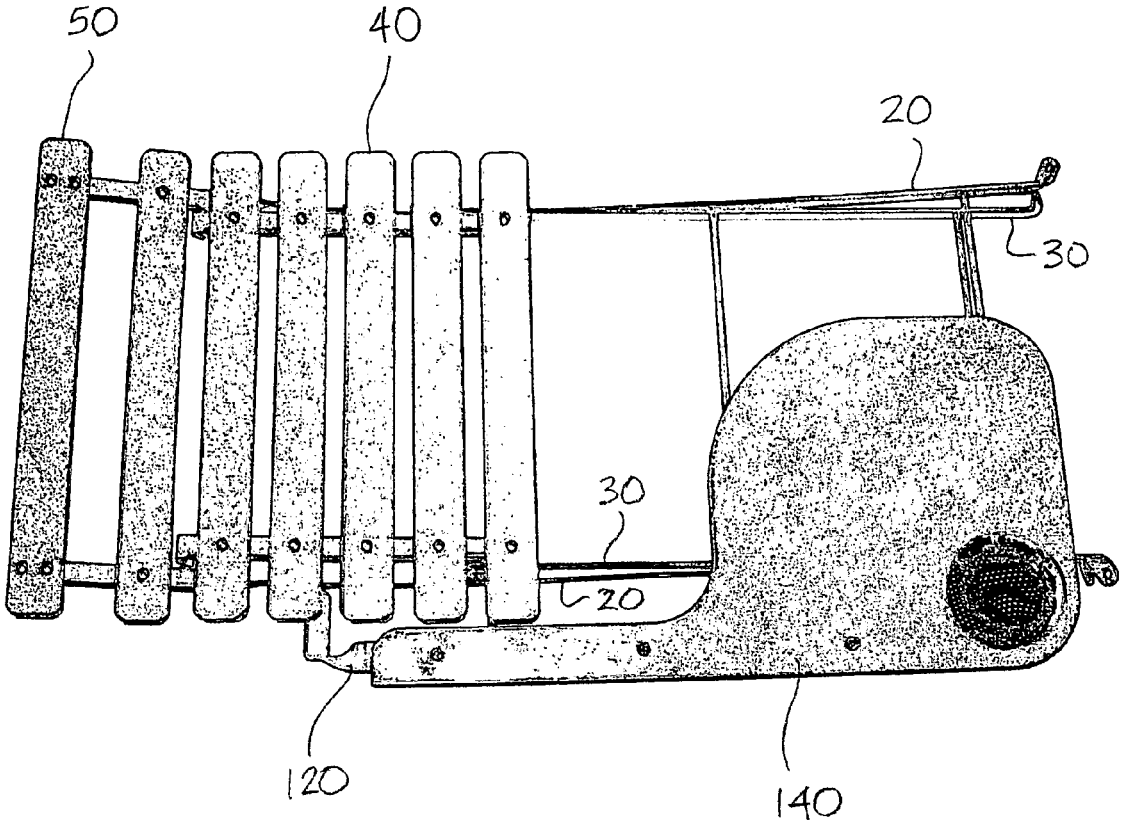
FIG. 9 is a front view of the foldable chair with integral table of FIG. 3 in a folded position.

In FIGS. 5 and 9, chair 10 is shown folded into the third or storage position. Chair 10 is folded by one or more actions such as sliding the backend of seat 40 up bars 20, proximate to backrest 50 pushing the front end of seat 40 into bars 20 or pushing bars 20 and legs 30 together. This force causes the rear of seat 40 up to move bars 20 and collapses the front end of seat 40, bars 30 and other extending portions such as arm 120 and table 140 down into a generally compact flat superposed position suitable for stacking.

Chair 10 can be folded into the third or storage position from either the first or second position. When chair 10 is folded into the third position from the first position, table 140 collapses at least partially onto the pairs of legs 20 and 30 of chair 10. Table 140 preferably does not extend beyond legs 20 and 30 in the folded position. Folding chair 10 into the third position from the second position requires an additional step of pivoting table 140 about hinge 130 to a position that is generally parallel with folded chair 10.

Although the illustrative embodiments of the present invention have been described herein with reference to the accompanying drawings, it is to be understood that the disclosure is not limited to those specific embodiments and that various other changes and modifications may be made therein by one skilled in the art without departing from the scope or spirit from the disclosure. All such changes and modifications are intended to be included in the scope of the invention as defined by appended claims.

What is claimed is:

1. A foldable chair having a backrest and seat and an integral table comprising:

a first pair of interconnected parallel frame members defining a back support portion and front leg and a second pair of interconnected parallel frame members defining a seat support portion and rear leg, the respective first and the second pair of frame members being joined for rotation below the seat;

a pair of seat supporting members each having one end pivotally connected to a middle portion of the first pair of frame members and an opposing end pivotally connected to the seat support portion of the second pair of frame members;

a table-supporting arm pivotally connected to the back supporting portion of one of the first pair of frame members, an opposing end of the table-supporting member being pivotally connected to a vertical supporting member extending upwardly from the end of the seat supporting portion of the second frame members; and a table mounted on the table supporting arm, the chair and table being foldable to a compact essentially flat configuration for storage, wherein a rear portion of the seat is upwardly moveable proximate the back support portion and the table is foldable to a position over the folded legs.

2. The folding chair with integral table of claim 1, wherein the table is rotatably mounted for movement between a first position in which the chair is positioned for seating and the table is oriented for use and a second position in which the chair is positioned for seating and the table is rotated to a stowed position beside the chair.

3. The folding chair with integral table of claim 2, wherein the table is joined to the arm by one or more hinges.

4. The folding chair with integral table of claim 1, wherein the table includes a receptacle.

5. The folding chair with integral table of claim 1, wherein the table is rotated from the use position to the stowed position through an angle of approximately 270 degrees.

6. The folding chair with integral table of claim 1, wherein the upper surface of the table is positioned facing the chair legs in the stowed position.

7. The folding chair with integral table of claim 1, wherein the table supporting arm is ergonomically configured to support a forearm or an elbow of a seated user.

8. A foldable chair with integral table comprising:

a first and a second pair of interconnected parallel frame members, the first pair of frame members defined by a back supporting portion, a rear seat supporting portion and a front leg portion, the second pair of frame members defined by a rear leg portion and forward seat supporting portion, the first and second frame members being pivotally joined at the upper end of their respective leg portions for scissors movement, a backrest extending between the back supporting frame members and a seat slidably mounted on the rear seat supporting portion and pivotally mounted on the forward seat supporting portion of the respective frame members, whereby the chair is folded for storage by raising the rear portion of the seat;

a table-supporting arm pivotally connected at one end to the back supporting portion of one frame member and pivotally connected at its opposite end to a supporting member, the supporting member being pivotally connected to the seat supporting portion of the second frame member;

a table rotatably connected to the arm, the table having an upper surface suitable for use as a working surface, whereby the chair and table are moveable between a first position in which the chair is positioned for seating and the table upper surface is oriented for use;

a second position in which the chair is positioned for seating and the table is rotated approximately 270° from a horizontal to a vertical position to a position, the supporting arm being suitable for use as an arm rest; and a folded position in which the chair and table are folded for storage with the table in a position over the folded chair legs.

9. The folding chair with integral table of claim 8, wherein the frame and supporting members are metal bar stock and the pivots are formed by rivets joining the members for rotation.

10. The folding chair with integral table of claim 8 in which the table in the use position is substantially horizontal.

11. The folding chair with integral table of claim 8, wherein the table further includes a receptacle for receiving beverage containers.

12. The folding chair with integral table of claim 11, wherein the hinge and table supporting arm are ergonomically configured to support a forearm or an elbow.

13. A folding chair with integral table comprising:

a first and a second pair of frame members pivotally joined for rotation in a scissors movement, a seat and a backrest supported by the frame members;

a table supporting arm pivotally connected at one end to one of the frame members proximate the backrest;

an arm supporting member pivotally connected to the opposite end of the table supporting arm and pivotally connected on the other frame member proximate the seat; and a table mounted on the table supporting arm, the table having a use position, a stowed position and a folded position, the chair having an open position for use and a folded position for storage, the chair in the use position including the table in a use position and a stowed position, the use position of the table including the lower surface of the table being above the seat and in the stowed position the table being rotated to a vertical position beside the chair, and the chair having a storage position wherein a rear portion of the seat is upwardly slidable proximate the backrest and the table is foldable to a position over the folded legs.

14. The folding chair with integral table of claim 13, wherein a hinge connects the arm and the table for rotation between the use position and the stowed position.

15. The folding chair with integral table of claim 13, wherein the table has a narrow rear portion defining an arm rest and a broadened front portion defining a working surface.

16. The folding chair with integral table of claim 13, wherein the surface of the table includes a receptacle.

17. The folding chair with integral table of claim 13, wherein a rear seat support is slidably positioned on an upper portion of one pair of frame members and a front end of the seat is rotatingly connected to an upper portion of the second pair of frame members.

18. The folding chair with integral table of claim 13, wherein the leading edge of the table does not extend beyond the ends of the legs when the chair is folded for storage.

19. The folding chair with integral table of claim 13, wherein the table supporting arm provides an armrest when the table is in the stowed position.

20. The folding chair with integral table of claim 13, wherein the table is made from a material selected from the group consisting of wood, plastic, metal and combinations thereof.

* * * * *